United States Patent [19]

Brandt et al.

[11] Patent Number: 4,548,404

[45] Date of Patent: Oct. 22, 1985

[54] METHOD AND APPARATUS FOR FORMING A STREAM OF PARTLY OVERLAPPING PAPER SHEETS

[75] Inventors: Eckhard Brandt, Norderstedt; Friedrich Schultz, Hamburg, both of Fed. Rep. of Germany

[73] Assignee: E.C.H. Will (GmbH & Co.), Hamburg, Fed. Rep. of Germany

[21] Appl. No.: 595,925

[22] Filed: Apr. 2, 1984

[30] Foreign Application Priority Data

Apr. 2, 1983 [DE] Fed. Rep. of Germany ..... 3312196

[51] Int. Cl.[4] ..... B65H 29/62; B65H 29/66; B65H 35/04

[52] U.S. Cl. ..... 271/303; 271/199; 271/202; 271/314; 198/462

[58] Field of Search ..... 271/202, 199, 216, 256, 271/258, 182, 183, 203, 314; 198/423, 462; 414/29; 83/88

[56] References Cited

U.S. PATENT DOCUMENTS

| | | | |
|---|---|---|---|
| 3,565,423 | 2/1971 | Kluth | 271/199 |
| 3,942,786 | 3/1976 | Lauren | 83/88 X |
| 3,948,153 | 4/1976 | Dutro et al. | 198/423 |
| 4,201,102 | 5/1980 | Rudszinat | 83/298 |
| 4,447,052 | 5/1984 | Müller | 271/258 X |

*Primary Examiner*—Bruce H. Stoner, Jr.
*Assistant Examiner*—Lawrence J. Goffney, Jr.
*Attorney, Agent, or Firm*—Peter K. Kontler

[57] ABSTRACT

A cross cutter subdivides a continuous paper web into a file of discrete randomly distributed satisfactory and unsatisfactory sheets which are advanced by a first transporting unit at an elevated first speed into the variable-width clearance between two superimposed conveyors of a second transporting unit which are driven at a lower second speed so that the sheets which enter the clearance are converted into a scalloped stream. Unsatisfactory sheets are removed from the first transporting unit and the width of the clearance is reduced in response to segregation of an unsatisfactory sheet or two or more successive unsatisfactory sheets to prevent the next-following satisfactory sheet from advancing through the clearance without deceleration by the two conveyors. The width of the clearance is restored to its original value in response to the passage of a preselected number of satisfactory sheets into the range of the second transporting unit following the segregation of one or more unsatisfactory sheets from the first transporting unit.

15 Claims, 4 Drawing Figures

METHOD AND APPARATUS FOR FORMING A STREAM OF PARTLY OVERLAPPING PAPER SHEETS

BACKGROUND OF THE INVENTION

The present invention relates to a method and apparatus for manipulating sheets which consist of paper or the like. More particularly, the invention relates to a method and apparatus for converting a series of discrete sheets into a so-called scalloped stream wherein a portion of each next-following sheet overlies a portion of the preceding sheet. Still more particularly, the invention relates to improvements in a method and in an apparatus of converting successive satisfactory sheets of a series of randomly distributed saitsfactory and unsatisfactory sheets into a scalloped stream between a cross cutter, which subdivides a single continuous running web or two or more overlapping running webs into a file of discrete sheets or groups of overlapping sheets, and a stacking station where the scalloped stream is converted into a succession of stacks of overlapping satisfactory sheets.

The making of a scalloped stream of partially overlapping sheets involves the transport of non-overlapping sheets or groups of sheets at a higher first speed and subsequent deceleration of successive sheets or groups of sheets to a lower second speed. As a rule, discrete sheets or discrete groups of overlapping sheets are obtained by drawing one or more webs from discrete reels or bobbins and advancing such webs through a cross cutter which severs the web or webs at regular intervals. The stacking of sheets is preceded by their conversion into a scalloped stream. This involves a deceleration or braking of successive sheets in a portion of their path between the cross cutter and the stacking station. The deceleration normally involves propulsion of the leaders of successive rapidly advancing sheets against the peripheral surface of a relatively slow braking or decelerating roller or drum with attendant reduction of speed and conversion of the series of sheets into a scalloped stream.

The above outlined technique of forming a scalloped stream is satisfactory as long as the series of discrete sheets consists of satisfactory sheets, i.e., as long as all of the sheets which constitute the series are disposed at the same distance from each other. This is not the case when the unsatisfactory sheets are segregated from satisfactory sheets between the cross cutter and the decelerating station. The segregation of one or more unsatisfactory sheets entails the development of longer gaps between certain satisfactory sheets, namely between the leader of a satisfactory sheet which follows one or more segregated unsatisfactory sheets and the trailing end of the preceding satisfactory sheet. If the sheets are advanced at an elevated speed, the foremost satisfactory sheet following one or more segregated unsatisfactory sheets is likely to advance past the braking or decelerating means without any deceleration and to create irregularities in the scalloped stream. This means that it is necessary to intervene into the automatic formation of the scalloped stream in order to reestablish the optimum conditions at the decelerating station. Each such intervention involves a reduction of the output and necessitates a continuous monitoring of the machine.

OBJECTS AND SUMMARY OF THE INVENTION

An object of the invention is to provide a novel and improved method of forming a scalloped stream of partially overlapping sheets with simultaneous separation of unsatisfactory (e.g., too short, too long, damaged and/or soiled) sheets from satisfactory sheets.

Another object of the invention is to provide a method which ensures the formation of a satisfactory scalloped stream regardless of the initial speed of sheets which advance toward the decelerating (stream forming) station.

A further object of the invention is to provide a method which automatically compensates for intermittent segregation of certain sheets ahead of the decelerating station so that the formation of the stream need not be monitored by attendants.

An additional object of the invention is to provide a novel and improved apparatus for the practice of the above outlined method and to construct and assemble the apparatus in such a way that the development of irregularities in the width of gaps between successive sheets approaching the decelerating station is compensated for automatically and as long as is necessary to reestablish the normal operating conditions.

A further object of the invention is to provide the above outlined apparatus with novel and improved sheet decelerating means.

Another object of the invention is to provide the apparatus with novel and improved means for adjusting the decelerating means.

One feature of the invention resides in the provision of a method of forming a stream of partially overlapping sheets, particularly paper sheets. The method comprises the steps of conveying a series of successive randomly distributed satisfactory and unsatisfactory sheets at a first speed along a first portion of an elongated path, introducing successive satisfactory sheets between two spaced-apart conveyors which define a second portion of the path and whose speed is less than the first speed so that the satisfactory sheets are decelerated and successive decelerated sheets partially overlap the preceding decelerated sheets, removing unsatisfactory sheets from the path in the region ahead of the two conveyors, reducing the spacing between the two conveyors upon removal of an unsatisfactory sheet from the path, and increasing the spacing between the conveyors upon introduction of a preselected number of satisfactory sheets into the second portion of the path following the removal of one or more unsatisfactory sheets from the path.

The conveyors are preferably disposed one above the other, and the spacing-reducing step can comprise moving at least a portion of the other (lower) conveyor toward the one (upper) conveyor.

Prior to removal of an unsatisfactory sheet from the path, the space between the two conveyors has a predetermined width; the spacing-increasing step preferably includes reestablishing such predetermined width of the space.

The method can further comprise the steps of subdividing at least one continuous web into a file of discrete (satisfactory and unsatisfactory) sheets, and introducing successive sheets of the file into the first portion of the path.

Another feature of the invention resides in the provision of an apparatus for forming a stream of partially overlapping sheets, particularly paper sheets. The apparatus comprises a first transporting unit which serves to advance a series of successive randomly distributed satisfactory and unsatisfactory sheets at a first speed along a first portion of an elongated (e.g., substantially horizontal) path, and a second transporting unit which serves to advance successive satisfactory sheets of the series along a second portion of the path. The second transporting unit includes first and second conveyors which are disposed at the opposite sides of the second portion of the path and define between themselves a clearance or space of variable width. The two conveyors serve to advance successive satisfactory sheets at a lower second speed with attendant conversion of the thus decelerated sheets into a stream of partially overlapping sheets. The apparatus further comprises means for deflecting or otherwise removing unsatisfactory sheets from the path ahead of the second portion, and adjusting means for reducing the width of the clearance from a first to a second value in response to removal of one or more unsatisfactory sheets from the path and for increasing such width back to the first value in response to entry of a preselected number of satisfactory sheets into the second portion of the path following removal of one or more unsatisfactory sheets from the path. The adjusting means comprises means for moving at least a portion of at least one of the first and second conveyors with reference to the other conveyor. The one conveyor can comprise an endless belt, and the other conveyor can comprise a rotary cylindrical member (e.g., a braking drum). The one conveyor is preferably disposed at a level below the other conveyor and can comprise an upwardly sloping portion immediately ahead of the aforementioned clearance.

The moving means can comprise a rotary member (e.g., an idler roller) and means for displacing the idler roller. Such displacing means can comprise a motor (preferably a fluid-operated motor) and motion transmitting means (e.g., one or more links and/or levers) between the motor and the rotary member. The idler roller is preferably pivotable between first and second positions to thereby effect a change in the width of the clearance between the first and second values.

The adjusting means is preferably arranged to move the one conveyor nearer to the other conveyor in automatic response to removal of an unsatisfactory sheet from the path, and to automatically move the one conveyor away from the other conveyor when a preselected number of satisfactory sheets (following a removed unsatisfactory sheet) enters the second portion of the path.

The first transporting unit can comprise a conveyor ahead of the removing means and a conveyor between the removing means and the second transporting unit.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
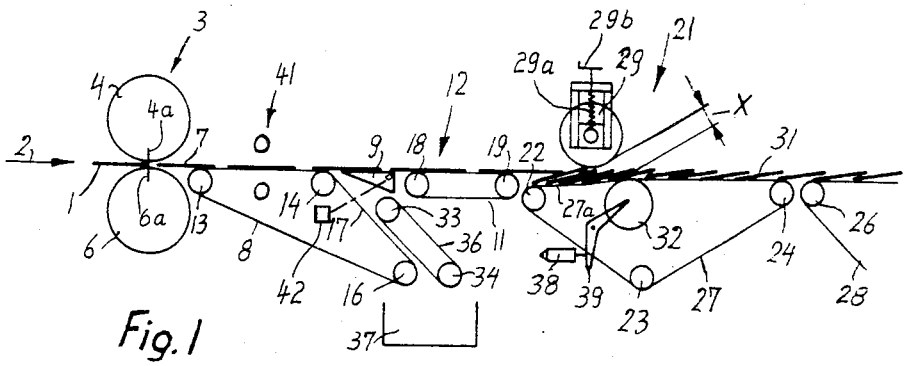
FIG. 1 is a schematic elevational view of an apparatus which embodies the invention, the parts of the apparatus being shown in positions they assume during normal operation.

Referring to FIG. 1, there is shown an apparatus which converts the major portion or portions of one or more continuous paper webs 1 into a scalloped stream 31 of partially overlapping sheets 7. Only one web 1 is actually shown; such web is advanced from a bobbin or reel in the direction of arrow 2 and is severed at regular intervals by the knives 4*a*, 6*a* on two rotary knife holders 4, 6 of a cross cutter 3. The latter may be constructed in a manner as disclosed in U.S. Pat. No. 4,201,102 granted to Rudszinat. The cross cutter 3 converts the web 1 into a file of randomly distributed satisfactory sheets 7 and unsatisfactory sheets 7' (see FIG. 2) and causes such sheets to advance into the range of a first transporting unit 12 including two spaced-apart belt conveyors 8 and 11. These conveyors are driven at the same (first) speed and are respectively trained over pulleys 13, 14, 16 and 18, 19. The upper reaches of the conveyors 8, 11 are disposed in a common horizontal plane and define a first portion of an elongated path for the sheets 7. The unsatisfactory sheets 7' are detected by a monitoring device 41 (e.g., a device including a light source and a photoelectronic transducer) during travel with the upper reach of the conveyor 8 and are intercepted by a pivotable deflecting or switching device 9 which normally constitutes a bridge between the upper reaches of the conveyors 8, 11 but is pivoted to the intercepting position of FIG. 2 in response to detection of an unsatisfactory sheet 7' by the monitoring device 9. The latter then transmits a signal to an electromagnet 42 or other suitable pivoting means for the device 9. The unsatisfactory sheet or sheets 7' are then caused to leave the first portion of the path for satisfactory sheets 7 by moving along the downwardly sloping reach 17 of the belt conveyor 8, along the downwardly sloping reach of an auxiliary belt conveyor 36 and into a receptacle 37. The auxiliary conveyor 36 is trained over pulleys 33 and 34.

The sheets 7 and 7' on the upper reach of the conveyor 8 are equidistant from one another. The satisfactory sheets 7 advance beyond the pulley 19 for the conveyor 11 and onto the upwardly sloping first portion 27*a* of the upper reach of an endless belt conveyor 27 forming part of a second transporting unit 21. The latter further comprises a second conveyor in the form of a driven rotary cylindrical member 29 which is biased to the position of FIG. 1 by a spring 29*a* and is movable upwardly by a crank 29*b* or the like. The peripheral speed of the member 29 (e.g., a braking drum) matches the speed of the conveyor 27 and is less than the speed of the conveyors 8, 11. The conveyor 27 and the lowermost portion of the peripheral surface of the rotary cylindrical member 29 define a space or clearance x of variable width. The means for adjusting the width of the clearance x comprises a moving member 32 (e.g., an idler roller) for the upper reach of the conveyor 27 and means for displacing the moving member 32. Such displacing means includes a fluid-operated (preferably pneumatic) motor 38 and a motion transmitting linkage 39 including one or more levers. In the illustrated embodiment, the moving member 32 is mounted on one arm of a two-armed lever and is pivotable between a first position (FIGS. 1, 2 and 3) at a greater first distance from the rotary member 29 and a second position (FIG. 3) at a lesser second distance from the rotary member 29. The conveyor 27 is trained over pulleys 22, 23, 24 (at least one of which is driven at the lesser second speed) and is followed by an additional belt conveyor 28 (trained over pulleys 26) which serves to deliver the scalloped stream 31 of partially overlapping satisfactory sheets 7 to a stacking station, not shown. The speed of the conveyor 28 matches that of the conveyors 27, 29 which define a second portion of the aforementioned path for the sheets 7. Such speed is substantially less than that of the belt conveyors 8 and 11.

The foremost part of the portion 27*a* of the conveyor 27 is disposed at a level below the upper reach of the conveyor 11. Therefore, the oncoming satisfactory sheets 7 impinge upon and are decelerated by the conveyor 27 in cooperation with the rotary member 29 to thus convert the oncoming sheets 7 into the scalloped stream 31.

Figure 2:
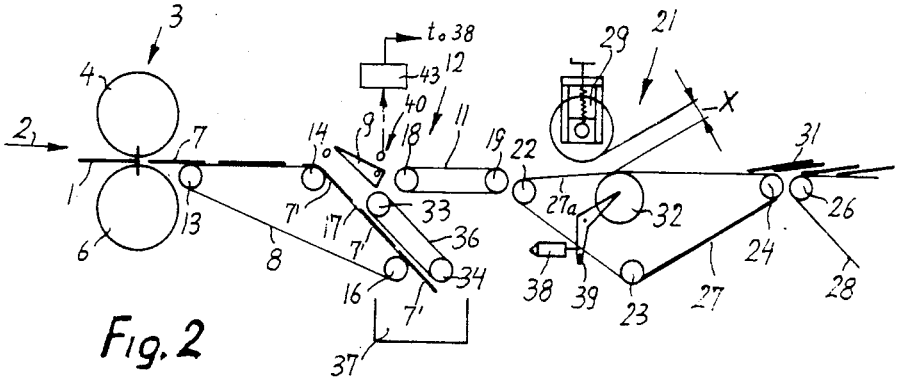
FIG. 2 illustrates the apparatus of FIG. 1, with the deflecting means in operative position during segregation of defective sheets from satisfactory sheets.
Figure 3:
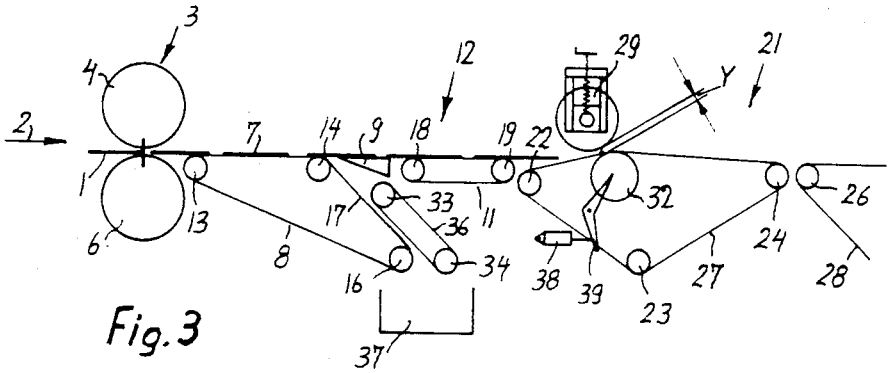
FIG. 3 shows the structure of FIGS. 1 and 2, with the parts of the decelerating means in positions they assume immediately upon resumption of normal operation following the segregation of defective sheets.

The reference numeral 40 denotes a monitoring device which detects the movement of the deflecting device 9 from the inoperative position of FIG. 1 to the operative position of FIG. 2 and initiates the movement of the idler roller 32 from the position of FIG. 2 to the position of FIG. 3 to thereby reduce the width of the clearance x between the conveyor 27 and rotary member 29 from the normal value (FIGS. 1, 2, 4) to the value y shown in FIG. 3. The monitoring device 40 is further connected with a counter 43 which resets the idler roller 32 to the normal position (FIG. 4) after the device 40 detects a preselected number of satisfactory sheets 7 or after elapse of a preselected interval of time which is required to ensure the advancement of a preselected number of satisfactory sheets from the conveyor 11 to the conveyor 27. The counter 43 can be connected directly with the monitoring device 41 if the latter is designed to generate first signals denoting detection of satisfactory sheets 7 and second signals denoting detection of unsatisfactory sheets 7'.

The crank 29*b* can be actuated to select the optimum value of normal width of the clearance x during normal operation of the apparatus, i.e., in the absence of unsatisfactory sheets 7'. The clearance x has a normal width such that the conveyor 27 cooperates with the conveyor (rotary member) 29 thereabove to ensure the formation of a satisfactory scalloped stream 31 wherein each next-following satisfactory sheet 7 overlies the preceding sheet 7 to a predetermined extent.

The file of randomly distributed satisfactory and unsatisfactory sheets 7, 7' which advance from the cross cutter 3 is transported by the conveyor 8 at a high speed, and all satisfactory sheets 7 reach the conveyor 11 which is driven at the same high speed. The satisfactory sheets 7 then enter the clearance x and are converted into the scalloped stream 31 which is transported away by the conveyor 28.

The stream 31 is interrupted whenever the device 9 deflects one or more unsatisfactory sheets 7' from the path which is defined by the transporting units 12 and 21. Were the width of the clearance x left unchanged, the first satisfactory sheet 7 following one or more removed unsatisfactory sheets 7' would shoot through such clearance without contacting the rotary member 29 and would not be decelerated to the speed of sheets 7 in the scalloped stream 31. The same would apply for the next satisfactory sheet 7 and so forth, i.e., the apparatus would fail to resume the formation of a scalloped stream. This is prevented by the novel expedient of reducing the width of the clearance x to the value y which ensures that the oncoming foremost satisfactory sheets 7 (following one or more segregated or removed unsatisfactory sheets 7') are invariably decelerated by the conveyor 27 in cooperation with the rotary member 29. Once the formation of the stream 31 is resumed, i.e., when the conveyor 27 receives a preselected number of sheets 7 from the conveyor 11 following return movement of the deflecting device 9 to the inoperative position (see FIG. 4), the displacing means 38, 39 pivots the idler roller 32 back to its lower end position so that the upper reach of the conveyor 27 descends and reestablishes the original width of the clearance x.

Figure 4:
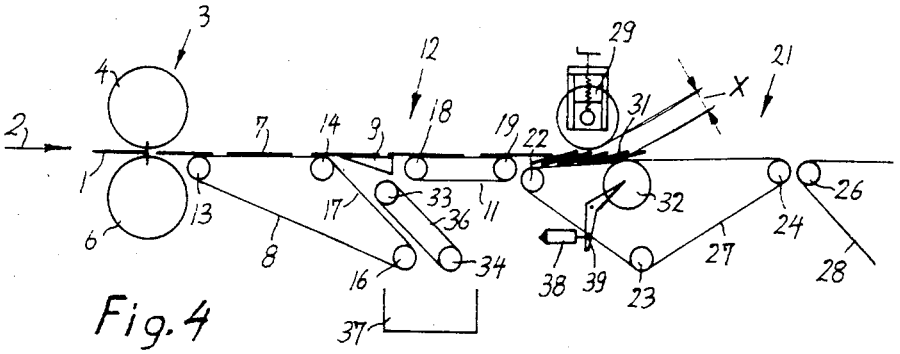
FIG. 4 illustrates the apparatus of FIGS. 1 to 3, with the parts of the decelerating means in positions they assume after elapse of a preselected interval following resumption of normal operation.

An important advantage of the improved method and apparatus is that the speed of the conveyors 8 and 11 need not be reduced preparatory or subsequent to removal of one or more unsatisfactory sheets 7' and also that the formation of a satisfactory scalloped stream 31 is resumed as soon as the first satisfactory sheet 7 (following return movement of the deflecting device 9 to its idle position shown in FIGS. 1, 2 and 4) advances into the clearance x. The adjustment of the width of such clearance is automatic, i.e., the operation need not be monitored by attendants.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of forming a stream of partially overlapping sheets, particularly paper sheets, comprising the steps of conveying a series of successive randomly distributed satisfactory and unsatisfactory sheets at a first speed along a first portion of an elongated path; introducing successive satisfactory sheets between two spaced-apart conveyors which define a second portion of said path and whose speed is less than said first speed so that the satisfactory sheets are decelerated and successive decelerated sheets partially overlap the preceding decelerated sheets; removing unsatisfactory sheets from said path in a region ahead of said second portion; reducing the spacing between the conveyors which define said second portion of said path in response to removal of an unsatisfactory sheet from said path; and increasing the spacing between the conveyors upon introduction of a preselected number of satisfactory sheets into the second portion of said path following the removal of one or more unsatisfactory sheets from said path.

2. The method of claim 1, wherein the conveyors which define the second portion of said path are disposed one above the other and said spacing reducing step includes moving at least a portion of the other conveyor upwardly nearer to the one conveyor.

3. The method of claim 1, wherein the space between the conveyors prior to removal of an unsatisfactory sheet has a predetermined width and said spacing-increasing step includes reestablishing said predetermined width of such space.

4. The method of claim 1, further comprising the steps of subdividing at least one continuous web into a file of discrete sheets and introducing successive sheets of the file into the first portion of said path.

5. Apparatus for forming a stream of partially overlapping sheets, particularly paper sheets, comprising a first transporting unit arranged to advance a series of successive randomly distributed satisfactory and unsatisfactory sheets at a first speed along a first portion of an elongated path; a second transporting unit arranged to advance successive satisfactory sheets of said series along a second portion of said path, said second unit including first and second conveyors disposed at the opposite sides of the second portion of said path and defining between themselves a clearance of variable width, said conveyors being arranged to advance successive satisfactory sheets at a lower second speed with attendant conversion of the thus decelerated sheets into a stream of partly overlapping sheets; means for deflecting unsatisfactory sheets from said path ahead of said second portion; and adjusting means for reducing the width of said clearance from a first to a second value in response to deflection of one or more unsatisfactory sheets from said path and for increasing such width back to said first value in response to entry of a preselected number of satisfactory sheets into the second portion of said path following deflection of one or more unsatisfactory sheets from said path.

6. The apparatus of claim 5, wherein said adjusting means includes means for moving at least a portion of at least one of said conveyors with reference to the other of said conveyors.

7. The apparatus of claim 6, wherein said one conveyor comprises an endless belt and said other conveyor comprises a rotary cylindrical member.

8. The apparatus of claim 6, wherein said one conveyor is disposed at a level below said other conveyor.

9. The apparatus of claim 6, wherein said moving means comprises a rotary member and means for displacing said rotary member, said displacing means comprising a motor and motion transmitting means interposed between said motor and said rotary member.

10. The apparatus of claim 9, wherein said motor is a fluid-operated motor.

11. The apparatus of claim 5, wherein said adjusting means includes a roller which is pivotable between first and second positions to thereby effect a change in the width of said clearance between said first and second values.

12. The apparatus of claim 5, wherein said adjusting means includes means for moving one of said conveyors nearer to the other of said conveyors in response to deflection of at least one unsatisfactory sheet from said path and for moving said one conveyor away from said other conveyor in response to detected entry of said preselected number of satisfactory sheets into said second portion of said path.

13. The apparatus of claim 5, wherein said first transporting unit comprises a third conveyor ahead of said deflecting means and a fourth conveyor between said deflecting means on the one hand and said first and second conveyors on the other hand.

14. The apparatus of claim 5, wherein said path is at least substantially horizontal.

15. The apparatus of claim 5, wherein one of said conveyors includes an upwardly sloping sheet-engaging portion disposed upstream of said clearance.

* * * * *